United States Patent [19]

Atchisson

[11] 4,285,221

[45] Aug. 25, 1981

[54] RETROFIT DOORKNOB LOCK APPARATUS

[76] Inventor: Maxwell G. Atchisson, 6695 Ridgemoore Dr., Doraville, Ga. 30360

[21] Appl. No.: 49,079

[22] Filed: Jun. 18, 1979

[51] Int. Cl.[3] ..... E05B 17/14

[52] U.S. Cl. ..... 70/416; 70/424; 70/428; 70/461

[58] Field of Search ..... 70/423, 424, 425, 426, 70/427, 428, 416, 207–212, 461

[56] References Cited

U.S. PATENT DOCUMENTS

| | | | |
|---|---|---|---|
| 1,439,552 | 12/1922 | Johnson | 70/424 |
| 3,167,945 | 2/1965 | Goodman | 70/428 |
| 3,340,709 | 9/1967 | Callahan | 70/428 |
| 3,343,387 | 9/1967 | Cochran | 70/424 |
| 3,457,745 | 7/1969 | Barber | 70/424 |
| 3,623,346 | 11/1971 | Curtin | 70/424 |
| 3,636,742 | 1/1972 | Raney | 70/424 |
| 3,738,137 | 6/1973 | Jones | 70/428 |
| 3,739,608 | 6/1973 | Young | 70/428 |
| 3,913,361 | 10/1975 | Fried | 70/424 |
| 3,952,564 | 4/1976 | Maines | 70/416 |

*Primary Examiner*—Robert L. Wolfe

*Attorney, Agent, or Firm*—Jones, Thomas & Askew

[57] ABSTRACT

Apparatus for securing a doorknob against unauthorized entry. A shroud fits over the entire doorknob and its associated shaft, and extends to fit on or over the rose through which the shaft extends. A clevis fits through slots in the shroud to retain the shroud in place on the door knob and shaft. The present apparatus can be used to retrofit a lock onto an existing knob which has no locking structure, and also prevents tampering or unauthorized access to an existing built-in lock cylinder of a doorknob.

4 Claims, 3 Drawing Figures

RETROFIT DOORKNOB LOCK APPARATUS

BACKGROUND OF THE INVENTION

This invention relates in general to locking apparatus, and in particular to apparatus for securing a doorknob against unauthorized entry.

The need to provide security for one's person and possessions has always been an important consideration, and rising crime statistics point out the need for even more concern for security. The desire for protection in one's home or business usually translates to the need for preventing or inhibiting unauthorized entry into a dwelling or other location, either to protect the occupants from intrusion or to secure the contents of the location.

Efforts to make a dwelling, office, or other location more secure usually include upgrading the locks on existing doors, or providing locks where none previously existed. Existing cylindrical locksets of the type having the lock cylinder mounted coaxially with the doorknob is typically one of the first items modified to increase security, because such knob locks are relatively easy to pick or to break for forced entry. As a practical matter, the existing knob locks are not actually replaced, but are supplemented by adding another lock to the door. While replacing or supplementing existing locks does increase security, that expedient becomes expensive where a dwelling or other location has several doors which must be protected. Moreover, that approach requires some skill and time at carpentry, and may be unfeasible where a person is a short-term occupant of the premises and does not want to spend money making permanent improvements.

In addition to increasing the security of external or outside doors, it is also desirable in many situations to lock one or more doors leading to a particular room in a dwelling or an office. Frequently, those room doors merely have a conventional doorknob latch and lack an existing lock of any kind, so that a particular room cannot be secured from unauthorized entry without spending the time and money to install a built-in door lock where none previously existed.

Various types of doorknob security devices are known in the art, which can be fastened in place to obscure or obstruct the keyhole of a conventional door knob lock. While the devices of the prior art may be effective for preventing unauthorized access to the keyhole, those devices generally leave at least part of the knob or its associated shaft accessible to damage by burglar tools such as a chisel or the like. The knob security devices of the art, moreover, tend to be relatively cumbersome and costly to manufacture. Furthermore, while such prior art devices may obstruct the keyhole of an existing knob lock, they offer no security for a door that does not have any existing knob lock.

Accordingly, it is an object of the present invention to provide improved doorknob lock apparatus.

It is another object of the present invention to provide doorknob lock apparatus which is readily adjustable to fit various sizes and styles of door knobs.

It is still another object of the present invention to provide doorknob lock apparatus which may be used to secure doorknobs lacking an existing knob lock.

BRIEF SUMMARY OF INVENTION

Stated in general terms, the doorknob lock of the present invention includes a shroud which fits over and entirely covers a doorknob and the shaft associated with the knob. The shroud preferably extends substantially flush with the "rose" or existing escutcheon of the doorknob, so that once in place, the shroud prevents any access to the knob or the associated shaft. The shroud contains a number of apertures at different spacings from its open end, and a securing device such as a clevis is positioned through a selected aperture to retain the shroud in place. A conventional padlock may be used to lock the securing device in place.

DETAILED DESCRIPTION OF PREFERRED EMBODIMENT

Figure 1:
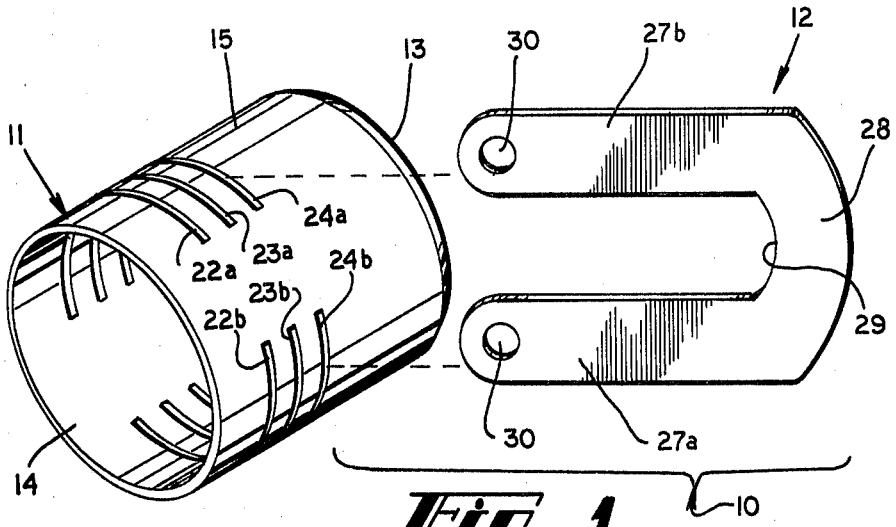
FIG. 1 shows an exploded pictorial view of a retrofit doorknob lock according to a preferred embodiment of the present invention.

Turning to FIG. 1, there is shown generally at 10 a retrofit doorknob lock apparatus of the disclosure embodiment and including a shroud 11 and a retaining member or clevis 12. The shroud 11 in the disclosed embodiment is of generally cylindrical and preferably unitary construction, having a first end 13 that is closed and a second end 14 that is open. The shroud 11 is molded or otherwise formed from a suitable material that is relatively durable and resistent to breaking under impact, such as various compositions of PVC, plastic-impregnated glass fiber, or the like. Alternatively, the shroud 11 can be made from ferrous or non-ferrous metals.

The interior diameter of the cylindrical shroud 11 should be slightly greater than the diameter of the largest doorknob with which the lock apparatus is intended for use. The interior length of the shroud 11, measured from the open end 14 to the inside of the closed end 13, should be adequate to accommodate the combined length of doorknob and associated knob shaft, as explained in greater detail below. Although the shroud 11 is described as being generally cylindrical, it should be understood that the exterior surface of the shroud may gradually taper from a larger diameter at the open end 14, to a somewhat smaller diameter at the closed end 13, to facilitate molding the shroud and to provide an oblique surface which tends to deflect hammer blows on the side wall 15 of the shroud. The inner surface of the side wall 15 should be smooth and devoid of any protrusion or other structural features that could engage the exterior surface of the doorknob 16, shown in FIG. 2. The open end 14 of the shroud 11 is preferably of sufficient diameter to fit around the "rose" 20, or external escutcheon, that fits around the door knob shaft 21 where the shaft extends outwardly from the door.

Returning to FIG. 1, it is seen that a number of slots are cut or otherwise formed in the side wall 15 of the shroud 11. The slots in the disclosed embodiment comprise several sets of slots 22*a*, 22*b*; 23*a*, 23*b*; and 24*a*, 24*b*; with each set having a first slot a at one location on the side wall and a second slot b at a diametrically opposed location on the side wall. The several sets of slots 22–24 are disposed on the side wall 15 at different longitudinal spacings from the open end 14 of the shroud 11; the selection of three sets of slots in the disclosed embodiment is illustrative, and it will be apparent that a smaller or larger number of slots can be provided. The slots 22–24, as will be apparent, provide an adjustable accommodation for the clevis 12 which may fit behind doorknobs 16 of various sizes and spacings from the door, and adjacent slot sets are located approximately $\frac{3}{8}''$ apart in one specific embodiment of the present invention.

The clevis 12 of the disclosed embodiment is a generally U-shaped unitary member, preferably stamped from a suitable metal such as cold-rolled steel or the like. The clevis 12 has a pair of arms 27*a* and 27*b* extending outwardly from a central portion 28, and the underside 29 of the central portion is preferably rounded at a radius which substantially conforms to the radius of the shroud side wall 15 at least in the vicinity of the slots 22–24. Spaced inwardly from the free end of each are 27*a* and 27*b* is a hole 30 of diameter sufficient to accommodate the shackle of a conventional padlock.

Figure 2:
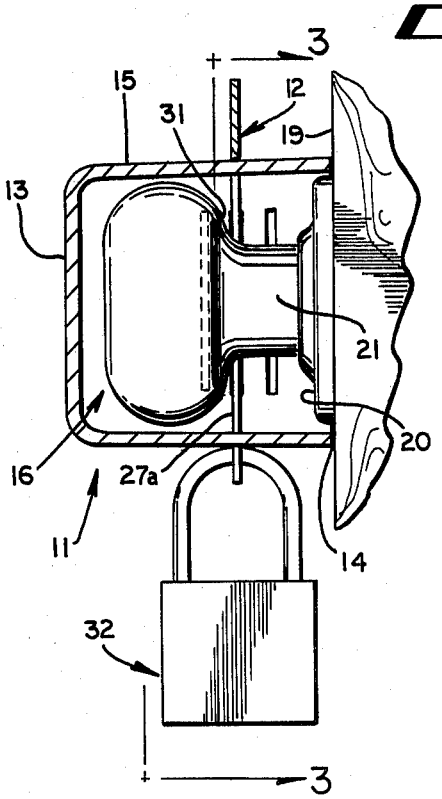
FIG. 2 shows a longitudinal section view of the disclosed embodiment, as installed on an existing doorknob.
Figure 3:
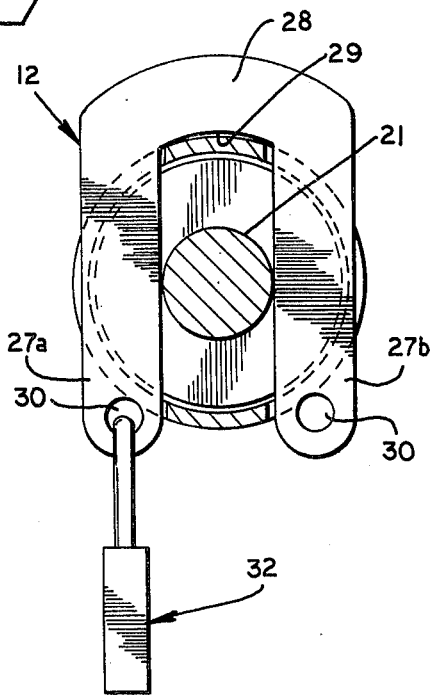
FIG. 3 shows a lateral section view of the disclosed embodiment, taken along section line 3—3 of FIG. 2.

The operation of the retrofit doorknob lock apparatus is now considered. The lock apparatus 10 is installed on a typical doorknob 16 by placing the shroud 11, with the clevis 12 temporarily detached, over the doorknob. The shroud 11 should be urged forwardly to a position where the open end 14 of the shroud fits over the rose 20, or abuts the rose if the diameter of the rose exceeds that of the open end 14, so that the knob 16 and substantially all of the shaft 21 associated with the knob are within the shroud. FIG. 2 shows a preferred arrangement of the shroud 11 in place on a typical doorknob, where the rose 20 fits within the open end 14 of the shroud. The clevis 12 is now inserted through a selected set of the slots 22–24 which places the arms 27*a* and 27*b* of the clevis in closely proximate relation to the inwardly-facing side 31 of the door knob 16. While the longitudinal location of the slots 22–24 along the shroud 11 may not permit the arms of the clevis 12 to fit exactly flush with the inwardly-facing side 31 of a particular knob, the clevis should be inserted in the set of slots which places the clevis arms closest to the side 31 of the knob, thereby retaining the shroud 11 substantially in position surrounding or contacting the rose 20. Installation of the lock apparatus 10 is completed simply by attaching a conventional padlock 32 through one of the holes 30 in the free ends of the clevis arms 27*a* and 27*b*, thereby preventing unauthorized removal of the clevis from the shroud.

Removal of the lock apparatus 10 is obvious from the foregoing, and merely requires detaching the padlock 32 and withdrawing the clevis 12 from the shroud 11 so that the shroud may be removed from the doorknob 16.

It will now be apparent that the shroud 11, when locked in place surrounding the doorknob 16 its associated shaft 21, makes any keyhole located in the doorknob completely unaccessible to tampering by picking, with a key or otherwise. It is also apparent that the door knob 16 cannot be readily removed by tools or by applying main force, since attempted blows with a hammer or other heavy instrument will be absorbed and partially deflected by the shroud 11 and the protruding clevis 12. Moreover, even where the doorknob 16 lacks any existing build-in lock, the presence of the shroud 11 on the doorknob and its associated shaft prevents anyone from grasping the knob to open the door. Thus, the present lock apparatus provides a retrofit function that is readily applicable to any conventional doorknob, without requiring installation and without permanently altering or disfiguring the door or its existing hardware, and that is readily removable when desired. This retrofit function is particularly useful where it is desired to temporarily secure a room that is not normally intended to be locked. For example, it may be desired to temporarily lock one room of a dwelling or an office where valuables are temporarily stored in that room or where the dwelling or office must be temporarily left in the presence of unsupervised strangers.

Each arm 27*a* and 27*b* of the clevis 12 has a hole 30 for inserting a padlock, so that the clevis can be inserted in a shroud 11 in relatively close quarters, such as adjacent a relatively massive door frame or a wall, without concern for positioning the clevis to place the hole away from any structure which might obstruct the padlock. Moreover, the presence of two padlock-receiving holes 30 permits the clevis 12 to be secured on the shroud 11 by two different padlocks that are separately keyed, so that each padlock must be removed by the person possessing the associated key before the door can be opened. That latter feature may be desirable in situations where access to a room is permitted only upon the authorization or presence of two individuals, each of whom possesses a key only to one of the two padlocks.

It will be understood that the foregoing refers only to a preferred embodiment of the present invention, and that numerous changes and modifications may be made therein without departing from the spirit and scope of the invention as defined in the following claims.

I claim:

1. Retrofit lock apparatus for a door knob, comprising:

means operative to fit over and entirely enclose a knob and associated shaft of a doorknob, so as to shroud the knob and shaft from unauthorized access; and means selectably operative to retain said enclosing means in place shrouding the knob and shaft;

said enclosing means comprising an enclosure having an open end to receive the knob and to permit said enclosure to fit over the knob and associated shaft;

said enclosure having a plurality of openings located at different spacings from said open end; and said retaining means extending within a selected one of said openings to maintain said enclosure in place shrouding the knob and shaft.

2. Apparatus as in claim 1, wherein:

said openings in said enclosure at each selected spacing from said open end comprise a set of openings, and each set of openings includes at least a pair of openings which are disposed alongside the shaft associated with the knob when said enclosure is in place shrouding the knob and shaft; and said retaining means selectably extends with in each opening of a selected set of openings, so as to engage the knob and prevent removal of said enclosure from the knob and shaft.

3. Apparatus as in claim 2, wherein:

each said set of openings comprises a slot formed in each side of said enclosure a selected spacing from said open end.

4. Apparatus as in claim 3, wherein:

said retaining means comprises a plate having a pair of arms joined together at one end and each having a free end;

said free ends of said plate being extendable through a selected set of slots in said enclosure; and means associated with at least one of said free ends to selectably prevent removal of said plate from said ots.

* * * * *